US007905022B2

(12) United States Patent
Hawk et al.

(10) Patent No.: US 7,905,022 B2
(45) Date of Patent: Mar. 15, 2011

(54) FOLDING KNIFE HAVING A LOCKING MECHANISM

(75) Inventors: Grant W. Hawk, Idaho City, ID (US); Gavin D. Hawk, Idaho City, ID (US)

(73) Assignee: KAI U.S.A., Ltd., Tualatin, OR (US)

( * ) Notice: Subject to any disclaimer, the term of this patent is extended or adjusted under 35 U.S.C. 154(b) by 0 days.

(21) Appl. No.: 12/699,573

(22) Filed: Feb. 3, 2010

(65) Prior Publication Data

US 2010/0132198 A1 Jun. 3, 2010

Related U.S. Application Data

(62) Division of application No. 11/374,289, filed on Sep. 16, 2005, now Pat. No. 7,681,316.

(51) Int. Cl.
*B26B 3/06* (2006.01)

(52) U.S. Cl. ..... 30/158; 30/160; 30/161

(58) Field of Classification Search ..... 30/160, 30/161, 158, 153, 154, 164, 157, 159, 155; 7/118, 132, 158, 125, 127
See application file for complete search history.

(56) References Cited

U.S. PATENT DOCUMENTS

| | | | | |
|---|---|---|---|---|
| 1,456,525 | A | | 5/1923 | West |
| 1,743,022 | A | | 1/1930 | Carman |
| 2,561,682 | A | | 7/1951 | Barnett |
| 2,596,294 | A | | 5/1952 | Schrade |
| 2,686,521 | A | | 8/1954 | Sheldon et al. |
| 4,040,081 | A | | 8/1977 | Ninomiya et al. |
| 4,173,068 | A | | 11/1979 | Cargill |
| 4,404,748 | A | | 9/1983 | Wiethoff |
| 4,451,982 | A | | 6/1984 | Collins |
| 4,502,221 | A | | 3/1985 | Pittman |
| 4,612,706 | A | * | 9/1986 | Yunes ..... 30/160 |
| 4,719,700 | A | | 1/1988 | Taylor, Jr. |
| 4,776,094 | A | | 10/1988 | Glesser |
| 4,805,303 | A | | 2/1989 | Gibbs |
| 4,811,486 | A | | 3/1989 | Cunningham |
| 4,837,932 | A | | 6/1989 | Elsener |
| 4,893,409 | A | | 1/1990 | Poehlmann |
| 4,974,323 | A | | 12/1990 | Cassady |
| 4,979,301 | A | | 12/1990 | Walker |
| 5,044,079 | A | | 9/1991 | Gibbs |
| 5,060,379 | A | | 10/1991 | Neely |
| 5,095,624 | A | | 3/1992 | Ennis |
| 5,111,581 | A | | 5/1992 | Collins |
| 5,293,690 | A | | 3/1994 | Cassady |

(Continued)

FOREIGN PATENT DOCUMENTS

DE 1104386 4/1961

*Primary Examiner* — Ghassem Alie
(74) *Attorney, Agent, or Firm* — Seed IP Law Group PLLC

(57) ABSTRACT

A folding knife includes a handle element, a blade rotatably coupled to the handle element, and a locking mechanism operatively coupled between the blade and the handle element. The locking mechanism includes first and second pairs of toggles positioned, respectively, on first and second sides of the blade, each pair of toggles being configured to move into a locked position when the blade is rotated to an open position. A handle of the knife may include the handle element and the first and second pairs of toggles.

17 Claims, 4 Drawing Sheets

U.S. PATENT DOCUMENTS 5,303,474 A * 4/1994 Keklak et al. ..... 30/162
D348,599 S 7/1994 Sakai
5,325,588 A 7/1994 Rogers
5,331,741 A 7/1994 Taylor, Jr.
5,425,175 A 6/1995 Rogers
5,426,855 A 6/1995 Keklak et al.
5,502,895 A 4/1996 Lemaire
5,515,610 A 5/1996 Levin et al.
5,537,750 A 7/1996 Seber et al.
5,546,662 A 8/1996 Seber et al.
D373,296 S 9/1996 Thompson
5,596,808 A 1/1997 Lake et al.
5,615,484 A 4/1997 Pittman
5,685,079 A 11/1997 Brothers et al.
5,689,885 A 11/1997 Walston
5,692,304 A 12/1997 Campbell
5,737,841 A 4/1998 McHenry et al.
5,755,035 A 5/1998 Weatherly
5,802,722 A 9/1998 Maxey et al.
5,815,927 A 10/1998 Collins
5,822,866 A 10/1998 Pardue
5,826,340 A 10/1998 Hull
5,887,347 A 3/1999 Gibbs
5,964,036 A 10/1999 Centofante
6,079,106 A 6/2000 Vallotton
6,154,965 A 12/2000 Sakai
6,338,431 B1 1/2002 Onion
6,360,443 B1 * 3/2002 Remus ..... 30/158
6,378,214 B1 4/2002 Onion
6,427,335 B1 8/2002 Ralph
6,438,848 B1 8/2002 McHenry et al.
6,490,797 B1 12/2002 Lake et al.
6,523,265 B2 * 2/2003 Eickhorn ..... 30/161
6,594,906 B1 7/2003 Sakai et al.
6,813,833 B2 * 11/2004 Saunders et al. ..... 30/162
7,124,509 B1 * 10/2006 Hawk ..... 30/160
2002/0157260 A1 10/2002 Cheng
2003/0070299 A1 4/2003 Frazer
2004/0031155 A1 2/2004 Hitchcock et al.
2006/0064877 A1 3/2006 Vallotton et al.

* cited by examiner

FOLDING KNIFE HAVING A LOCKING MECHANISM

CROSS-REFERENCE TO RELATED APPLICATION

This application is a divisional application of U.S. patent application Ser. No. 11/374,289, filed Sep. 16, 2005, now pending, which application is incorporated herein by reference in its entirety.

BACKGROUND OF THE INVENTION

1. Field of the Invention

The present disclosure relates generally to a folding knife, and particularly to a folding knife with a locking mechanism.

2. Description of the Related Art

Folding knives enjoy wide popularity, particularly among sportsmen, campers, hikers, and many others engaged in outdoor activities. Common elements to folding knives include a handle and a blade pivotally connected to an end of the handle so that the blade pivots with respect to the handle between an open position in which the blade is extended away from the handle, and a closed position in which the blade is at least partially received within the handle. Many folding knives also include a locking mechanism to maintain the blade in the open position and/or the closed position.

Examples of folding knives, including folding knives with locking mechanisms, may be found in U.S. Pat. Nos. 1,454,665; 1,743,022; 4,040,081; 4,173,068; 4,404,748; 4,451,982; 4,502,221; 4,612,706; 4,719,700; 4,776,094; 4,805,303; 4,811,486; 4,837,932; 4,893,409; 4,974,323; 4,979,301; 5,044,079; 5,060,379; 5,095,624; 5,111,581; 5,293,690; 5,325,588; 5,331,741; 5,425,175; 5,426,855; 5,502,895; 5,515,610; 5,537,750; 5,546,662; 5,596,808; 5,615,484; 5,685,079; 5,689,885; 5,692,304; 5,737,841; 5,755,035; 5,802,722; 5,815,927; 5,822,866; 5,826,340; 5,887,347; 5,964,036; 6,079,106; 6,154,965; 6,338,431; 6,378,214; 6,427,335; 6,438,848; 6,490,797; 6,594,906; D348,599, and D373,296; and U.S. Patent Application Nos. 2002/0157260; 2003/0070299; and 2004/0031155, the entire disclosures of which are herein incorporated by reference for all purposes.

DETAILED DESCRIPTION OF THE INVENTION

In the following description and the accompanying figures, certain specific details are set forth in order to provide a thorough understanding of various embodiments of the invention. However, one skilled in the art will understand that the invention may be practiced without these details.

Embodiments of the present invention relate generally to folding knives. For the purpose of this disclosure, the portion of a knife handle into which the blade is received while folded, generally including a slot or channel, will be referred to as the top or front, while the portion opposite will be referred to as the back or bottom of the handle or knife. Where practical, depictions of knives will be oriented in the figures accordingly, to avoid confusion. These and other terms that logically follow, such as side and end, are used for convenience and clarity, and do not limit the scope of the invention. Likewise, directional terms, such as force vectors and rotational directions, are to be understood with reference to the structure as shown in the accompanying figures, and are not intended to limit the scope of the invention.

Figure 1:
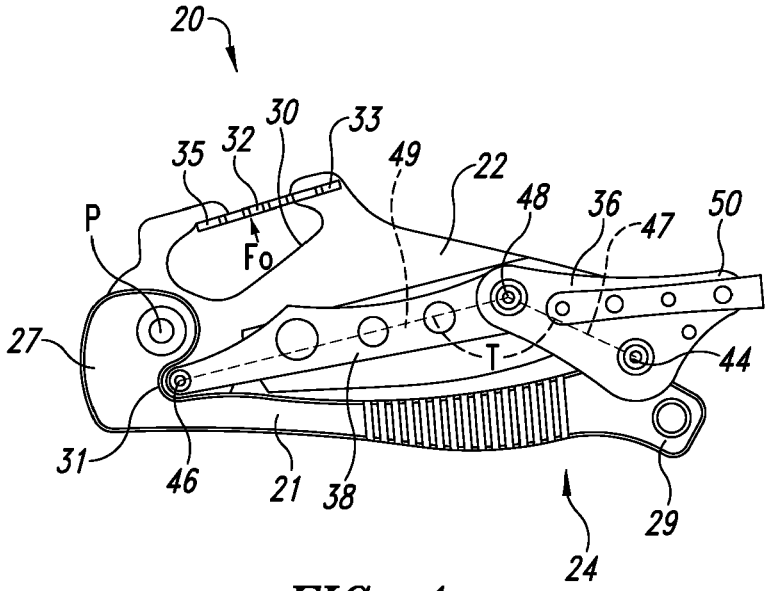
FIG. 1 is a side view of a folding knife according to an embodiment of the invention, shown with the blade in a closed position.

FIGS. 1-6 depict an embodiment of a folding knife 20 having a blade 22, a handle 24, and a locking mechanism 28. Blade 22 includes a tang 23 pivotally connected to the handle 24. The blade 22 pivots with respect to the handle 24 about a pivot axis P between an open position (FIG. 3) and a closed position (FIG. 1). In the open position, the blade 22 extends away from the handle 24, where it is deployed and ready for use. Rotation of the blade toward the open position may be limited by contact between a portion of the blade and a portion of the handle when the blade is in the fully open position. Alternatively, rotation toward the open position may be limited by some other limiting means such as are known in the art.

From the open position, the blade 22 may be folded towards the handle 24, pivoting about pivot axis P, into the closed position. In the closed position, blade 22 extends along handle 24. Rotation of the blade toward the closed position may also be limited by any of a variety of methods, one of which is described below.

While the blade 22 may be any suitable shape, in the pictured embodiment, the blade 22 includes an aperture 30. The blade 22 also includes a gate element 32 configured to provide access to the aperture 30. The gate element 32 is coupled at a first end 33 thereof to the blade 22 and configured to pivot or flex such that a second end 35 is movable between a closed and an open position. The gate element 32 is configured such that it is free to move when the blade 22 is in the closed position. However, when the blade 22 is moved to the open position, the second end 35 of the gate element 32 comes to bear against an engagement surface 25 of the handle 24 such that the gate element 32 is fixed in its closed position. Additionally, in the present embodiment, contact of the gate element 32 with the engagement surface 25 serves to limit travel of the blade 22 toward the open position. Accordingly, the open position of the blade 22 can be defined as the point in rotation of the blade 22 at which the gate element 32 contacts the engagement surface.

The aperture 30 and gate element 32 may be used to serve any suitable purpose. For example, the aperture 30 and gate element 32 may provide means for storing the knife by hanging the knife on rings, cords, etc. Additionally, or alternatively, gate element 32 may allow the user to pivot blade 22 to the open position by applying an opening force Fo on the gate element and/or to pivot blade 22 to the closed position by applying a closing force Fc on the gate element 32. While the blade 22 is in the open position, the gate element 32 provides a stable platform against which a user may place a thumb to apply pressure against the blade during a cutting operation.

Although gate element 32 is shown to be in the form of a pivoting closure, any suitable structure configured to provide access to one or more apertures may be used, such as a leaf spring, sliding gate, etc. Additionally, although knife 20 is shown to include one aperture 30 and one gate element 32, any suitable combination of apertures and gate elements may be used, including no apertures and/or no gate elements.

Figure 6:
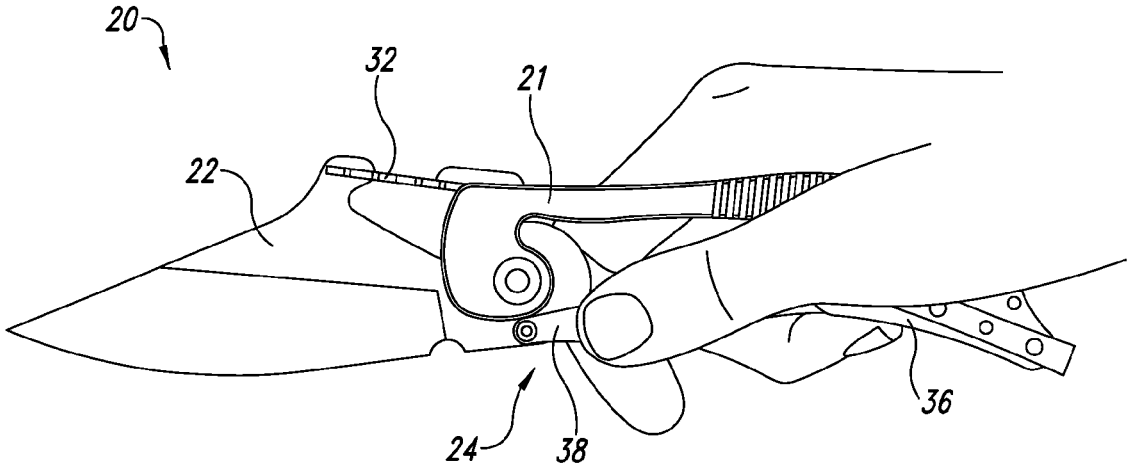
FIG. 6 is an isometric view showing a user's hand positioned for using the knife of FIG. 1 with the blade in the open position.

Handle 24 includes a handle element 21 and a locking mechanism 28. The combined handle element 21 and locking mechanism 28 form a skeletal type handle through which the cutting edge of the blade 22 may be visible, but is nevertheless protected from inadvertent contact by the cooperation of the handle element 21 with the locking mechanism 28. The handle element 21 forms a back portion of the handle 24 and is provided with a contoured shape to cooperate ergonomically with a user's hand while in use. The locking mechanism 28 forms a front portion of the handle 24. Components of the locking mechanism 28 are contoured to comfortably receive a user's fingers wrapped therearound while in use, as shown in FIG. 6. The shapes and contours of the handle 24 may be selected according to desired ergonomic and aesthetic considerations independent of the mechanical operation of the knife 20, described below.

Handle element 21 includes first and second ends 27, 29. Tang 23 of blade 22 is pivotally connected to handle element 21 at the first end 27. Handle element 21 includes a receiving notch 31, shaped and configured to receive a part of the locking mechanism 28, as further described below.

Figure 5:
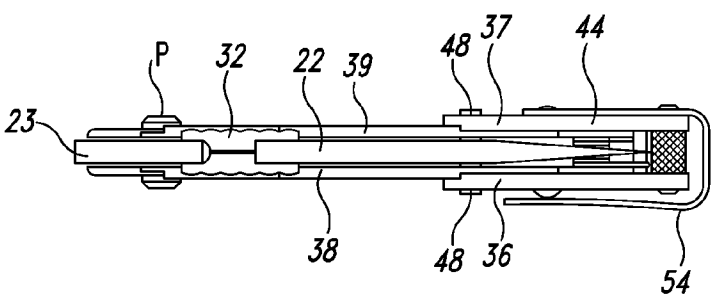
FIG. 5 is a front plan view of the knife of FIG. 1, shown with the blade in the closed position.

The locking mechanism 28 includes short toggles 36 and 37 and long toggles 38 and 39. It may be seen, with reference to FIGS. 4 and 5, which show the knife 20 in plan view, that short and long toggles 36 and 38 are positioned on a first side of the knife 20, while short and long toggles 37 and 39 are positioned on a second side of the knife 20. The short and long toggles 36 and 38 and the short and long toggles 37 and 39 define respective sides of a channel into which the blade is received while in the closed position, as shown in FIGS. 1 and 5.

For the purposes of this description, the structure and operation of the knife 20 will largely be described with reference to FIGS. 1-3, which show side elevation views of the knife 20, looking at the first side thereof. Accordingly, the description will refer primarily to short and long toggles 36, 38, visible in these figures. The structure of the knife 20 is functionally symmetrical, and so it will be understood that the interaction of the short and long toggles 37, 39 with other components of the knife 20 is essentially identical to that described with reference to short and long toggles 36, 38, respectively.

Figure 2:
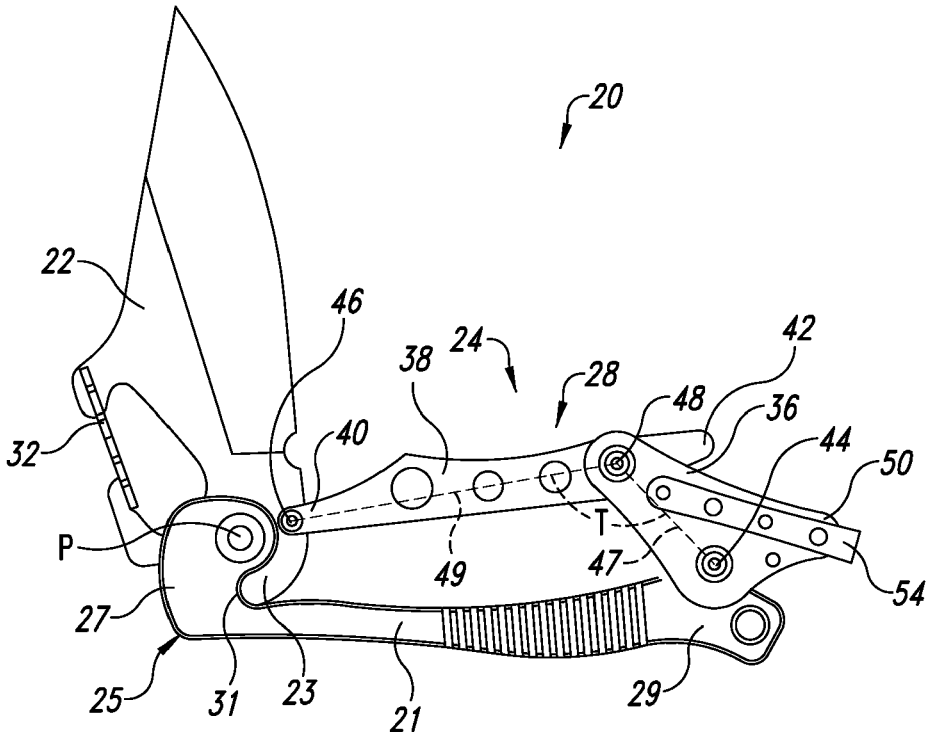
FIG. 2 is a side view of the knife of FIG. 1, shown with the blade in an intermediate position.
Figure 3:
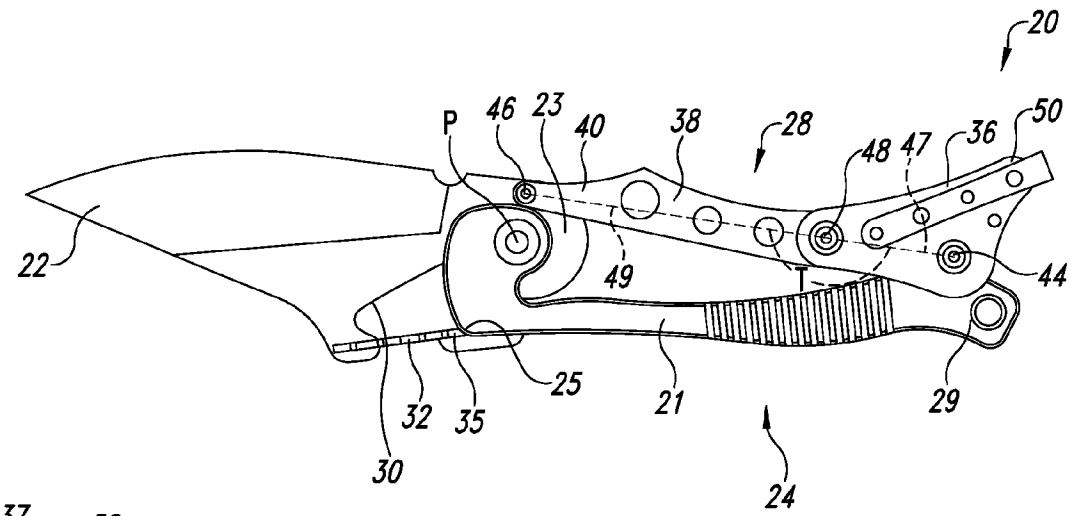
FIG. 3 is a side view of the knife of FIG. 1, shown with the blade in an open position.

Referring now to FIGS. 1-3, the short toggle 36 is pivotally connected to the second end 29 of handle element 21 at a first pivot point 44. long toggle 38 includes a first end 40, which is pivotally connected to the tang 23 of blade 22 at a second pivot point 46, and a second end 42, which is pivotally connected to the long toggle 36 at a third pivot point 48.

Rotation points such as pivot points 44, 46, and 48, as well as pivot axis P, define points at which various components of the knife 20 are rotatably coupled such that the components so coupled are rotatable with respect to each other. The coupling at these points may be effected by the use of rivets, nuts and bolts, pins, bushings, bearings, or any other type of fastener that fulfills the functional requirements.

Figure 4:
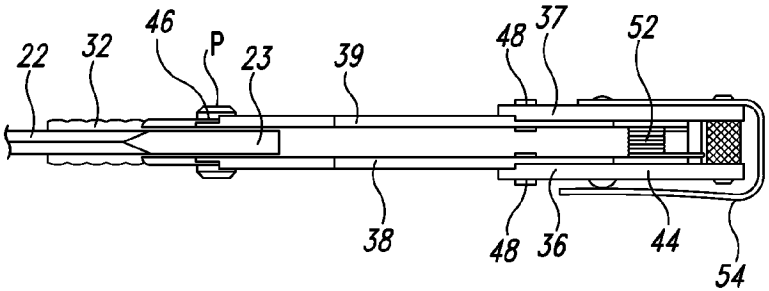
FIG. 4 is a front plan view of the knife of FIG. 1, shown with the blade in the open position.

The first and second pivot points 44, 46 traverse the knife 20 such that, in the case of the first pivot point 44, both short toggles 36 and 37 are coupled to the handle by a single fastener, and, in the case of the second pivot point 46, both long toggles 38 and 39 are coupled to the blade by a single fastener. Third pivot point 48 comprises two separate fasteners, a first fastener coupling the long and short toggles 36 and 38 on the first side of the knife 20, and a second fastener coupling the long and short toggles 37 and 39 on the second side of the knife, as shown in FIGS. 4 and 5. This arrangement allows the blade 22 to pass between the two fasteners of the third pivot point 48 as it moves between the open and closed positions. FIGS. 4 and 5 also show a clip 54, provided as an alternate means for securing the knife 20.

Also shown in FIGS. 4 and 5, a torsion spring 52 is positioned on the fastener at the first pivot point 44. The spring 52 is configured to apply a rotational bias to the short toggles 36 and 37 in a counterclockwise direction (as viewed in FIGS. 1-3), relative to the handle element 21.

A first line 47 is defined by the short toggle 36 between the first and third pivot points 44, 48, while a second line 49 is defined by the long toggle 38 between the second and third pivot points 46, 48. A toggle angle T is defined by the angle of the first line 47 with respect to the second line 49.

While the blade 22 is in the closed position, as shown in FIG. 1, the first end 40 of the long toggle 38 engages the receiving notch 31 of the handle element 21. Contact between the first end 40 and the receiving notch 31 limits travel of the blade 22 as it moves toward the closed position. Accordingly, the closed position of the blade 22 may be defined as the point in the rotation of the blade 22 at which the first end 40 of the long toggle 38 contacts the receiving notch 31.

When the blade 22 is moved toward the open position, the pivot point 46 follows an arcuate path around the pivot axis P of the blade 22. As it does so, the long toggle 38 rotates about second pivot point 46 with respect to the blade 22, and moves, first, toward the second end 29 of the handle element 21 as the blade 22 approaches a mid-point of travel, and, as the blade passes the mid-point of travel toward the open position, moves away from the second end 29 of the handle element 21. As a result of the movement of the long toggle 38, the third pivot point 48 also moves relative to the handle 22. Because the short toggle 36 is coupled to the handle element 21 at first pivot point 44, movement of the third pivot point 48 causes the short toggle 36 to rotate with respect to the handle element 21 about the first pivot point 44, and with respect to the long toggle 38 about third pivot point 48.

While the blade 22 is in the closed position, as shown in FIG. 1, the toggle angle T, as defined by the first and second lines 47, 49, has a first value of less than 180°. As the blade 22 moves toward the mid-point of travel between the closed and open positions, as shown in FIG. 2, the toggle angle T decreases. As the blade moves beyond the mid-point of travel, the toggle angle T again increases, until, when the blade reaches the open position, the toggle angle T is equal to or greater than 180°, as shown in FIG. 3. In the configuration shown in FIG. 3, the locking mechanism is in the locked positioned, as explained below.

The shape of the second end 42 of the long toggle is selected such that the second end 42 contacts the handle element 21 when the blade 22 is in the open position. Accordingly, the short toggle 36 cannot rotate in a counterclockwise direction beyond the position achieved when the blade 22 is in the open position. Therefore, in order for the blade to be moved back toward the closed position, the short toggle 36 must rotate in a clockwise direction, and the third pivot point must rotate away from the handle 22.

Because the torsion spring 52 applies a counterclockwise rotational bias to the short toggle 36, the spring resists movement of the blade 22 away from the closed position while the blade is in the closed position. When the blade is rotated beyond the midpoint of travel toward the open position, the bias of the spring 52 urges the blade 22 toward the open position and resists movement of the blade away from the open position while the blade is in that position.

It will be recognized that, while the toggle angle T is equal to or greater than 180°, no amount of force on the blade 22 toward the closed position will cause the short toggle 36 to spontaneously rotate in the clockwise direction. Thus, the blade 22 is automatically locked in the open position by the toggle action of the locking mechanism 28 and the bias of the spring 52. On the other hand, pressure on a heel 50 of the short toggle 36 sufficient to overcome the spring bias will cause the short toggle 36 to rotate away from its locked position and allow the blade 22 to freely rotate to the closed position.

FIG. 6 shows the knife 20 in the hand of a user. It may be seen that the short and long toggles 36, 37, 38, 39 define the front portion of the gripping surface of the handle 24, and that the simple act of gripping the handle applies pressure to the lock mechanism 28, insuring that the mechanism remains in the locked position.

According to one embodiment, the locking mechanism moves easily into the locked position when the blade 22 is rotated to the open position. According to an alternate embodiment, the blade 22 reaches the open position before the locking mechanism 28 reaches the locked position. That is to say that the blade 22 contacts the handle element 21 or other limiting feature while the toggle angle is just shy of 180°. At this point, the user applies downward pressure at the third pivot point 48, thereby loading all the rotation points of the knife 20, and forcing the locking mechanism 28 into the locked position. In this way, constant tension is maintained on the locking mechanism while the blade 22 is in the open position, which eliminates movement and play from the blade, and further discourages spontaneous release of the locking mechanism 28.

Figure 7:
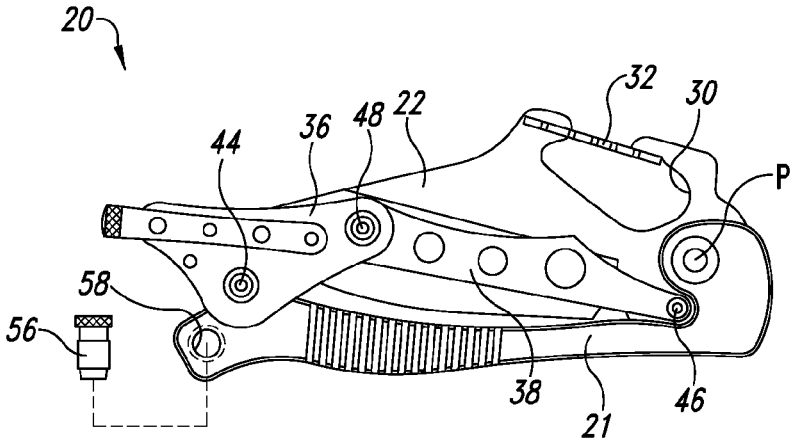
FIG. 7 is a side view of the knife according to an embodiment of the invention, shown with a wrench removed from a handle frame.

According to an embodiment of the invention, the fastener at the first pivot point 44 is provided with an eccentric boss and threaded end. Accordingly, by rotating the fastener relative to the handle element 21, the precise position of the first pivot point 44 can be adjusted, thereby adjusting the operation of the locking mechanism 28. To accomplish this, a nut affixed to the threaded end of the fastener is loosened and the fastener is rotated to adjust the position of the first pivot point 44. The nut is then tightened to lock the fastener in place. FIG. 7 shows the knife 20 with a wrench 56 sized for this purpose. According to the illustrated embodiment, the nut is stored in an aperture 58 formed in the handle element 21 for this purpose.

Figure 8A:
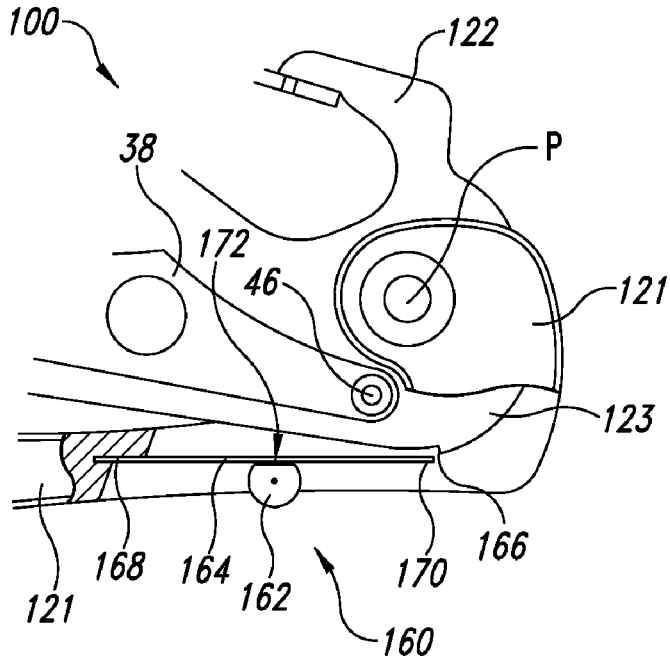
FIGS. 8A and 8B are cutaway views of a portion of a knife according to another embodiment of the invention, showing a safety lock in an open and a closed position, respectively.
Figure 8B:
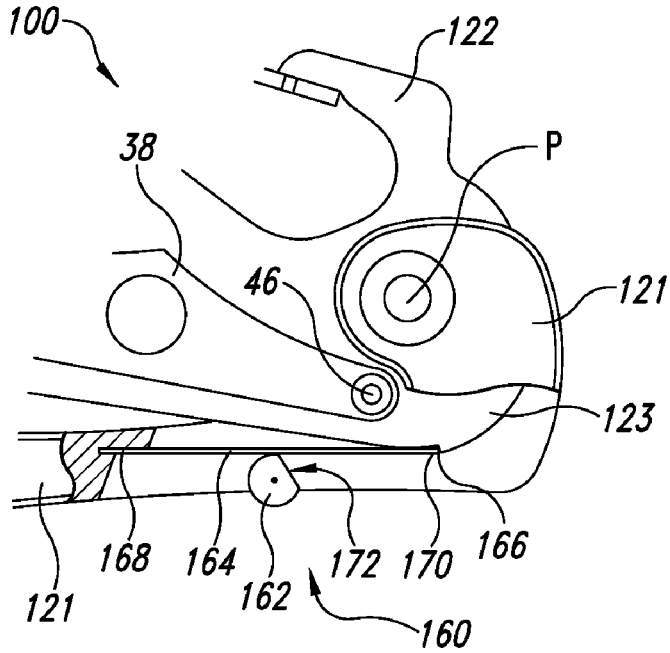

FIGS. 8A and 8B show a partial cutaway view of the knife 100 incorporating a safety lock 160 according to an embodiment of the invention. The safety lock 160 is configured to permit a user to lock a blade 122 in the closed position such that it cannot be opened without first releasing the safety lock 160.

The safety lock 160 includes a cam-wheel 162, and a locking rod 164 coupled at a first end 168 to the handle element 121. The locking rod 164 has a downward bias and bears against the cam-wheel 162. A second end 170 of the locking rod extends toward the tang 123 of the blade 122. The tang 123 includes a locking notch 166 positioned to receive the second end 170 of the locking rod 164 while in the locked position.

FIG. 8A shows the safety lock 160 in the unlocked position. In this position, the cam-wheel 162 is oriented such that the locking rod 164 bears against a flattened face 172 of the cam-wheel 162, and the second end 170 of the locking rod 164 is disengaged from the locking notch 166.

FIG. 8B shows the safety lock 160 in the locked position. In this position, the cam-wheel 162 is rotated to an orientation in which the locking rod 164 bears against a larger radius portion of the cam-wheel 162, causing the second end 170 of the locking rod 164 to move toward the tang 121. The second end 170 of the locking rod 164 is received in the locking notch 166 of the tang 123.

To lock or unlock the safety lock, a user merely moves the cam-wheel 162 with a thumb or finger. While the cam-wheel 162 is in the unlocked position, as shown in FIG. 8A the blade 122 may be rotated toward the open position without interference. However, when the cam-wheel 162 is rotated to the position shown in FIG. 8B, the locking notch 166 engages the second end 170 of the locking rod 164, which prevents further rotation of the blade 122, securely holding the blade in the closed position.

Though not shown in the figures, the cam-wheel may be provided with a détente to stop rotation of the cam-wheel at the position shown in FIG. 8A when rotated in the counterclockwise direction for example, and to stop rotation of the cam-wheel 162 at the position shown in FIG. 8B when rotated in the clockwise direction. In this way, by sliding back with the thumb over the cam-wheel until it stops (i.e., in the clockwise direction), a user may be assured that the safety lock 160 is engaged. Conversely, by pushing forward with the thumb over the cam-wheel until it stops (i.e., in the counterclockwise direction), a user may easily and quickly disengage the safety lock 160.

Although various embodiment of the invention have been described here to illustrate the principles of the invention, those skilled in the art will recognize that various changes in form and detail may be made. Embodiments of the invention may not include all of the features disclosed here with reference to a particular embodiment. Additionally, features disclosed here may be combined with known structures of devices. such combinations also fall within the scope of the invention.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A folding knife comprising:

a blade; and a handle, including:

a handle element having a first end and a second end spaced at an opposite end of the handle element from the first end, the blade being pivotably coupled to the first end of the handle element permitting the blade to rotate between an open and a closed position, a first toggle element pivotably coupled to the second end of the handle element at a first fixed pivot axis, and a second toggle element having third and fourth ends, the second toggle element being pivotably coupled at the third end to the blade at a second fixed pivot axis and the fourth end being pivotably coupled to the first toggle element at a third pivot axis, the first and second toggle elements being exposed for contact by a user and comprising a gripping surface of the handle.

2. The folding knife of claim 1 wherein an angle defined by a first line extending between the first and third pivot axes and a second line extending between the second and third pivot axes changes as the blade is rotated between the closed and open positions, and reaches a minimum value while the blade is between the closed and open positions, and a maximum value when the blade is at the open position.

3. The folding knife of claim 2 wherein the maximum value of the angle is equal to or greater than 180°.

4. The folding knife of claim 1 wherein the third end of the second toggle element engages a notch formed in the handle element when the blade is in the closed position.

5. The folding knife of claim 1 further comprising:

a locking notch formed in a tang of the blade;

a cam element coupled to the handle element and configured to rotate between lock and unlock positions; and a locking rod coupled to the handle element and configured to bear against the cam element such that, while the cam element is in the lock position, an end of the locking rod is received into the locking notch, and while the cam element is in the unlock position, the end of the locking rod is away from the locking notch.

6. The folding knife of claim 1 wherein an angle defined by a first line extending between the first and third pivot axes, and a second line extending between the second and third pivot axes changes as the blade is rotated between the closed and open positions, and reaches a minimum value while the blade is between the closed and open positions, and is at approximately 180 degrees when the blade is at the open position.

7. The folding knife of claim 1 wherein the fourth end of the second toggle element contacts the handle element when the blade is in the open position.

8. The folding knife of claim 1 wherein the blade includes a sharpened edge and a non-sharpened edge opposite the sharpened edge, the non-sharpened edge being shaped so as to form an aperture.

9. The folding knife of claim 8 wherein the blade includes a gate having first and second ends, coupled at the first end to the blade on one side of the aperture, the gate being movable between a first position in which the gate extends across the aperture such that the second end of the gate is adjacent to an opposite side of the aperture, and a second position in which the second end of the gate is positioned away from the opposite side of the aperture.

10. The folding knife of claim 9 wherein, while the blade is in the open position, the gate cannot be moved from the first position.

11. The folding knife of claim 2, comprising a bias element operatively coupled to the handle and arranged so as to urge movement of the first and second toggle elements toward the maximum angle.

12. A folding knife, comprising:

a blade; and a handle, including:

a handle element having first and second ends, the blade being pivotably coupled to the first end such that the blade is rotatable between an open and a closed position, a first toggle element pivotably coupled to the second end of the handle element at a first pivot point, a second toggle element having third and fourth ends, pivotably coupled at the third end to the blade at a second pivot point and the fourth end to the first toggle element at a third pivot point, the first and second toggle elements comprising a gripping surface of the handle, wherein the first and second toggle elements are pivotable in respective planes that lie parallel to, and offset from, a plane of rotation of the blade, and third and fourth toggle elements shaped and positioned so as to substantially mirror the first and second toggle elements on an opposite side of the blade.

13. A folding knife, comprising:

a handle element;

a blade rotatably coupled to the handle element; and a first pair of toggles coupled together by a first fastener and operatively coupled between a tang of the blade and the handle element, on a first side of the blade; and a second pair of toggles coupled together by a second fastener, separate from the first fastener, and operatively coupled between the tang of the blade and the handle element, on a second side of the blade, the blade being configured to rotate, from an open position in which the blade extends from the handle element and first and second pairs of toggles, to a closed position in which a portion of the blade is located between the first and second fasteners.

14. The folding knife of claim 13 wherein the first and second pairs of toggles are configured to move into a locked position when the blade is rotated to the open position.

15. The folding knife of claim 13, comprising a handle that includes the handle element and the first and second pairs of toggles, the first and second pairs of toggles each comprising a respective gripping surface of the handle.

16. The folding knife of claim 13 wherein a first end of each of the first and second pairs of toggles is rotatably coupled to the blade by a third fastener and a second end of each of the first and second pairs of toggles is rotatably coupled to the handle element by a fourth fastener.

17. The folding knife of claim 15 wherein each of the first and second pairs of toggles comprises a long toggle and a short toggle rotatably coupled together, the long toggles also coupled to the blade and the short toggles also coupled to the handle element.

* * * * *